US006497500B1

(12) United States Patent
Bradford

(10) Patent No.: US 6,497,500 B1
(45) Date of Patent: Dec. 24, 2002

(54) ASYMMETRIC FLOOD LIGHTING REFLECTOR AND APPARATUS FOR MAKING SAME

(75) Inventor: Reed A. Bradford, Hendersonville, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/683,089

(22) Filed: Nov. 16, 2001

(51) Int. Cl.[7] ..... F21V 7/00

(52) U.S. Cl. ..... 362/297; 362/302; 362/304; 362/346

(58) Field of Search ..... 362/297, 346, 362/548, 302, 304; 359/850

(56) References Cited

U.S. PATENT DOCUMENTS

| | | | | |
|---|---|---|---|---|
| 1,950,380 A | | 3/1934 | Arrs | |
| 3,257,553 A | | 6/1966 | Tolbert | |
| 4,041,306 A | | 8/1977 | Compton et al. | |
| 4,218,727 A | | 8/1980 | Shemitz et al. | |
| 4,242,727 A | | 12/1980 | deVos et al. | |
| 4,575,783 A | * | 3/1986 | Hammond | 362/145 |
| 4,575,788 A | | 3/1986 | Lewin | |
| 4,694,382 A | | 9/1987 | Sales | |
| 4,789,923 A | | 12/1988 | Sales | |
| 5,544,030 A | | 8/1996 | Wijbenga | |
| 5,607,229 A | * | 3/1997 | Rykowski et al. | 362/297 |
| 5,645,344 A | | 7/1997 | Wijbenga | |
| 5,816,694 A | * | 10/1998 | Ideker et al. | 362/297 |
| 5,941,632 A | * | 8/1999 | Wedell et al. | 362/255 |

* cited by examiner

*Primary Examiner*—Sandra O'Shea
*Assistant Examiner*—Guiyoung Lee
(74) *Attorney, Agent, or Firm*—Fay, Sharpe, Fagan, Minnich & McKee, LLP

(57) ABSTRACT

An asymmetric flood light includes a reflector comprised of a hydroformed continuous metal form which defines a lamp space adapted to receive a lamp. The reflector has a forward opening for outputting light generated by the associated lamp. The reflector further includes a rear reflector section arranged rearward of the lamp space and adapted to reflect backward-directed lamp illumination forward in a crossing pattern, a forward reflector section disposed forward of the rear reflector section and adapted to reflect lamp illumination forward in a crossing pattern, and a plurality of planar surfaces that connect the forward and rear reflector sections. The hydroformed reflector is adapted to cooperate with the lamp to produce a substantially rectangular area of substantially uniform illumination that is asymmetrically disposed relative to the reflector.

21 Claims, 6 Drawing Sheets

ASYMMETRIC FLOOD LIGHTING REFLECTOR AND APPARATUS FOR MAKING SAME

BACKGROUND OF INVENTION

The invention relates to the lighting arts. It is especially applicable to providing substantially uniform rectangular flood lighting of vertical walls or other flat vertical structures, and will be described with particular reference thereto. However, the invention is not limited thereto, and will also find application in other flood lighting tasks, such as the illumination of non-flat vertical objects, perimeter illumination of outdoor surfaces such as parking lots, football fields, and the like, and uniform illumination of indoor flooring using wall-mounted flood lights.

Flood lighting is typically used in parking lots, athletic fields, and other areas to provide illumination for convenience and safety. Similarly, architectural features such as building walls are advantageously uniformly illuminated at night. Flood lighting is designed to illuminate large areas, preferably with relatively uniform illumination across the area. To appropriately distribute the light output, the electric lamps that produce the light are typically coupled with a reflector. The reflector geometry for transforming the essentially point light source distribution of a conventional incandescent lamp, halogen lamp, or metal halide lamp into a wide-area, spatially uniform flood light illumination is typically rather complex. This is particularly the case for asymmetric flood lighting in which the flood light is not located symmetrically directly above the surface to be illuminated, but rather is located at a side, such cases arising for example in lighting parking lots from the perimeter, lighting athletic fields from the sidelines, lighting tall buildings from flood lights positioned relatively near ground level, and the like. Additionally, in such situations a substantially rectangular illumination of a substantially flat surface is typically desired, which further complicates the geometric requirements of the flood light reflector.

In the past, these complex geometric requirements have been met using multi-faceted segmented reflectors. These reflectors are assembled from multiple strips of pre-finished reflective metal, sometimes having various finishes. Segmented reflectors are relatively simple to manufacture since the required shaping can be accomplished using conventional and low cost sheet metal shaping techniques. However, these prior art reflectors have several disadvantages. They require labor-intensive assembly of the multiple parts, either at the factory or in the field, e.g. by the customer. The multiple-component fabrication introduces potential failure mechanisms at the interconnections. The multiple segments can have various types of surface finishes and segment interconnections of varying optical quality, producing lighting non-uniformities and other optical degradation.

Single-piece reflectors, which are typically machine-pressed from a single sheet of aluminum or other metal blank, are also known. U.S. Pat. No. 5,816,694, which has the same assignee as the present invention and is incorporated by reference herein, discloses a hydroformed symmetrical flood light reflector that produces a square light distribution. However, because of their more complex reflection geometry, asymmetrical flood light reflectors have in the past been produced in multi-segmented fashion rather than as single-piece reflectors.

The present invention contemplates an improved reflector that overcomes the above-mentioned limitations and others.

SUMMARY OF INVENTION

In accordance with one embodiment of the present invention, an asymmetric flood light reflector is disclosed. A hydroformed. continuous metal form defines a lamp space that is adapted to receive an associated lamp. The metal form has a forward opening for outputting light generated by the associated lamp. The metal form further includes a rear reflector section arranged rearward of the lamp space and adapted to reflect backward-directed lamp illumination forward in a crossing pattern, a forward reflector section disposed forward of the rear reflector section and adapted to reflect lamp illumination forward in a crossing pattern, and a plurality of planar surfaces that connect the forward and rear reflector sections. The hydroformed continuous metal form is adapted to cooperate with the associated lamp to produce a substantially rectangular area of substantially uniform illumination that is asymmetrically disposed relative to the reflector.

In accordance with another embodiment of the present invention, a flood light is disclosed, including a light source and an asymmetric reflector. The asymmetric reflector comprises a single, continuous, reflective metal sheet that is formed to include a plurality of reflective sub-surfaces. The reflector cooperates with the light source to produce uniform lighting over a rectangular area located asymmetrically relative to the flood light.

In accordance with yet another embodiment of the present invention, a method is disclosed for flood lighting a rectangular area in a substantially uniform manner. Light is generated at a spatial point asymmetrically located relative to the rectangular area. The generated light is reflected onto the rectangular area using a single metal sheet that has a pre-selected deformation shape adapted to reflect the generated light into the rectangular area with varying light intensity to provide substantially uniform illumination throughout the rectangular area.

In accordance with still yet another embodiment of the present invention, an apparatus for manufacturing an asymmetric flood light reflector is disclosed. The apparatus includes a punch element that is adapted for use with a hydroform press. The punch element conforms with the inner surface of an asymmetric flood light reflector.

Numerous advantages and benefits of the present invention will become apparent to those of ordinary skill in the art upon reading and understanding the following detailed description.

BRIEF DESCRIPTION OF DRAWINGS

The invention may take form in various components and arrangements of components, and in various steps and arrangements of steps. The drawings are only for purposes of illustrating the preferred embodiments and are not to be construed as limiting the invention.

DETAILED DESCRIPTION

Figure 1:
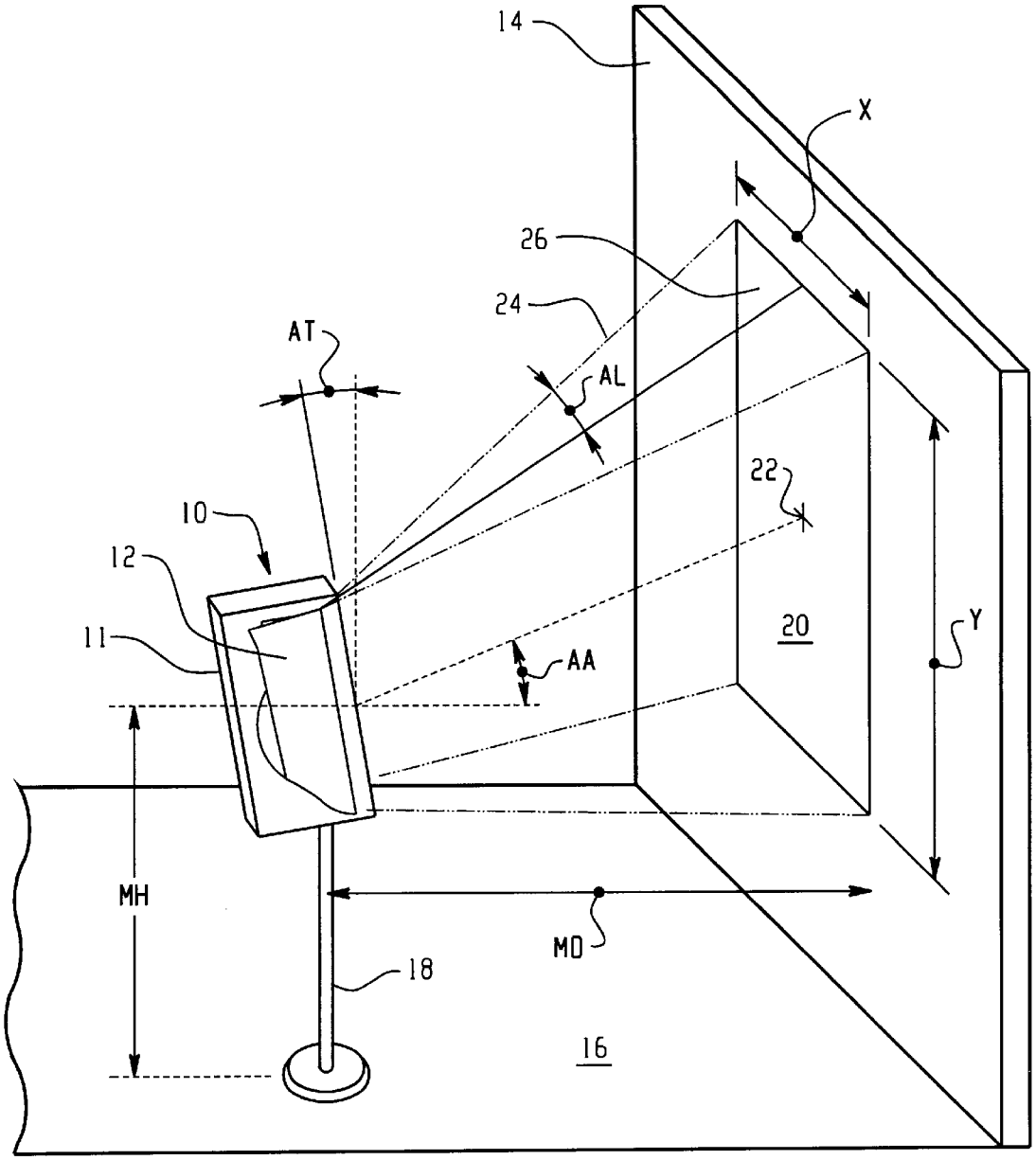
FIG. 1 shows an exemplary flood light that suitably practices an embodiment of the invention.

With reference to FIG. 1, an asymmetric flood light 10 includes a housing 11 containing an asymmetric reflector 12 and a lamp, light bulb, or other light source (not shown). The housing 11 protects the reflector, lamp, and associated electronic components (not shown). The reflector 12 includes a single formed piece of sheet metal. The flood light 10 is shown in FIG. 1 lighting a portion of a wall 14. The flood light 10 is fixedly positioned at a pre-determined distance MD from the wall 14, and at a pre-determined height MH above the ground 16 using any suitable mounting apparatus, such as a mounting pole 18. The flood light 10 illuminates a substantially rectangular area 20 of the wall 14. The flood light 10 is mounted at a selected tilt angle AT.

The lighting area 20 at the wall has a horizontal dimension X and a vertical dimension Y as shown, a center 22, and is lit with substantially uniform intensity over the area of the lighting pattern 20. Those skilled in the art will recognize that the dimensions X and Y of the lighting area 20 are advantageously quantified in units of the flood light 10 mounting distance MD from the illuminated wall 14, in the illustrated case of FIG. 1, or equivalently in units of mounting height for a flood light illuminating a horizontal surface such as a parking lot or other horizontal area (arrangement not shown).

The reflector 12 is an asymmetric distribution reflector that produces a substantially rectangular light beam 24 directed upward (in the illustrated case of a vertically oriented asymmetric distribution reflector) so that the center 22 of the lighting area 20 is higher off the ground than the mounting height MH the flood lamp 10. The upward thrust of the beam 24 is advantageously characterized by an azimuth angle AA. As seen in FIG. 1, the flood light 10 and the illuminated rectangular area 20 are asymmetrically relatively disposed, and a distal portion 26 of the rectangular area 20 is defined as a consequence of the asymmetric (non-zero) azimuth angle AA.

In FIG. 1, the flood light 10 is shown illuminating a vertical surface or wall, which could for example be the side of a house, multi-story building, or the like, an auditorium wall, atrium wall, or other substantially flat vertical structure. Although not shown herein, the flood light 10 could also be used to illuminate non-flat vertical objects, such as a tree. Similarly, those skilled in the art will appreciate that the flood light 10 having asymmetric reflector 12 is also adaptable for producing substantially uniform illumination over a selected horizontal area, such as the illumination of a parking lot surface by a flood light located near the lot perimeter, illumination of an auditorium or atrium floor by a flood light located on a wall, and similar lighting applications.

Figure 2:
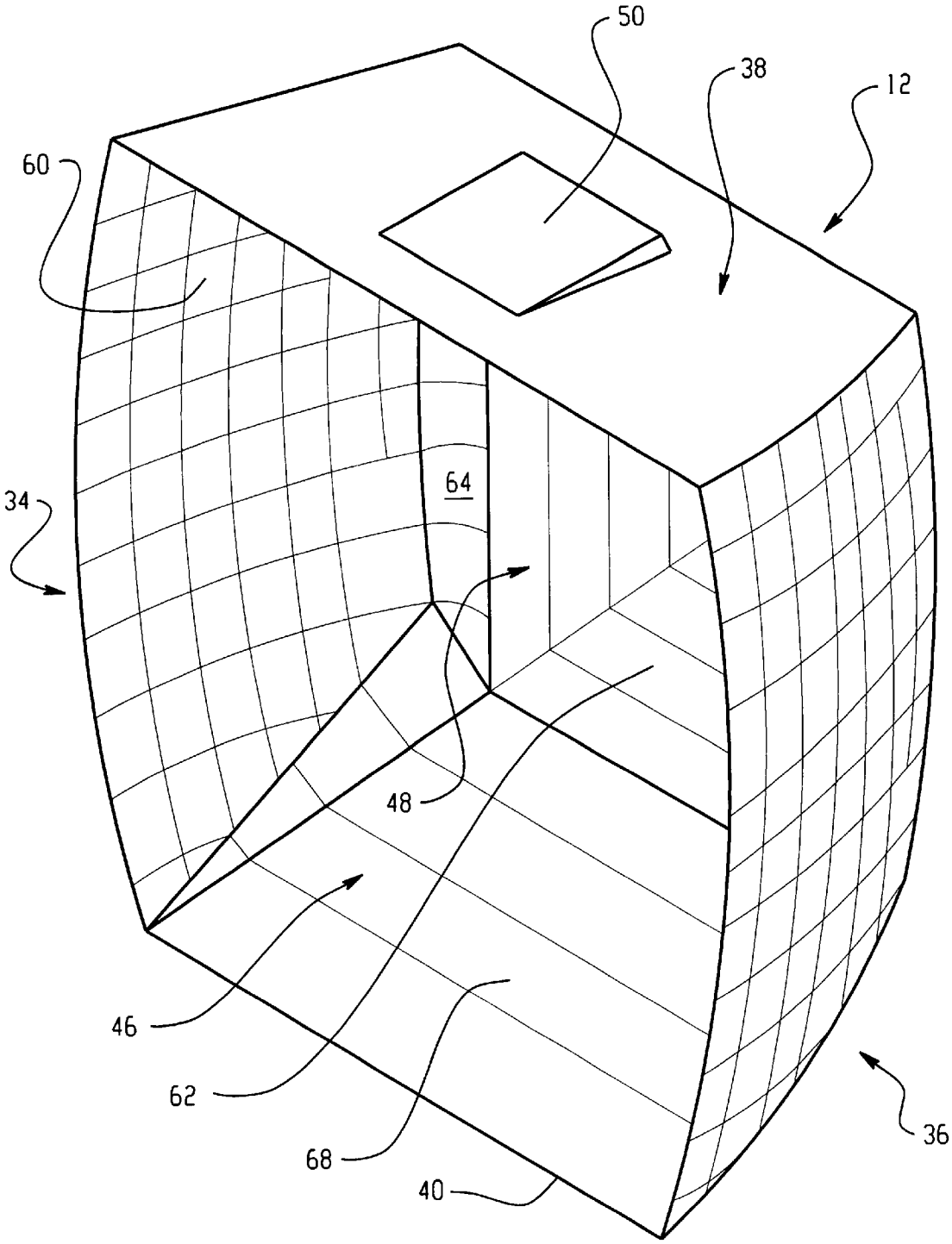
FIG. 2 shows an isometric view of an exemplary flood light reflector that suitably practices an embodiment of the invention.
Figure 3:
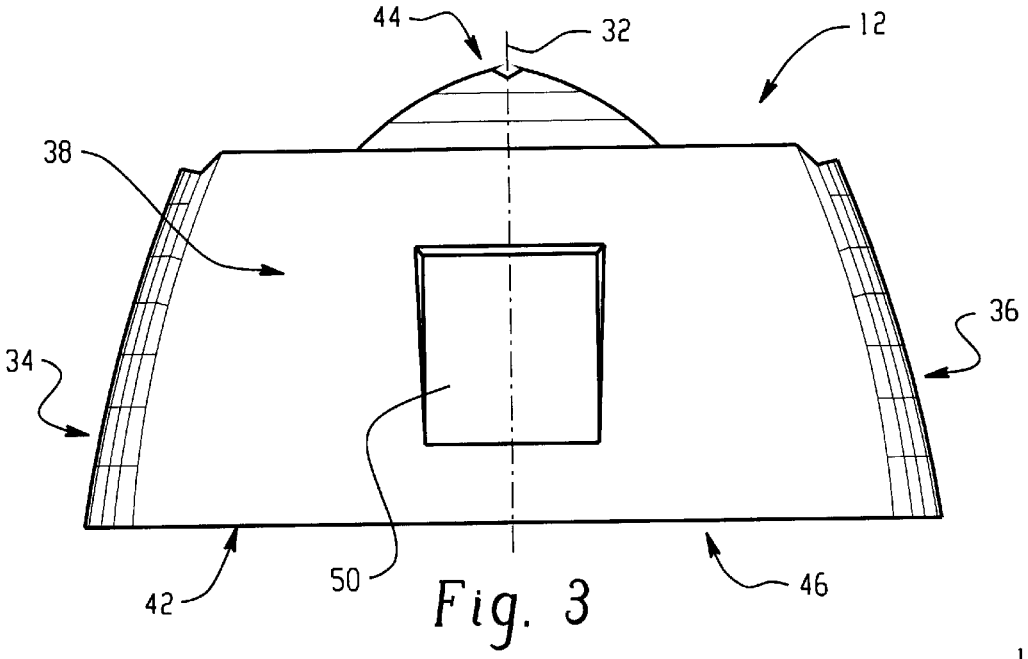
FIG. 3 shows a top view of the reflector of FIG. 2.
Figure 4:
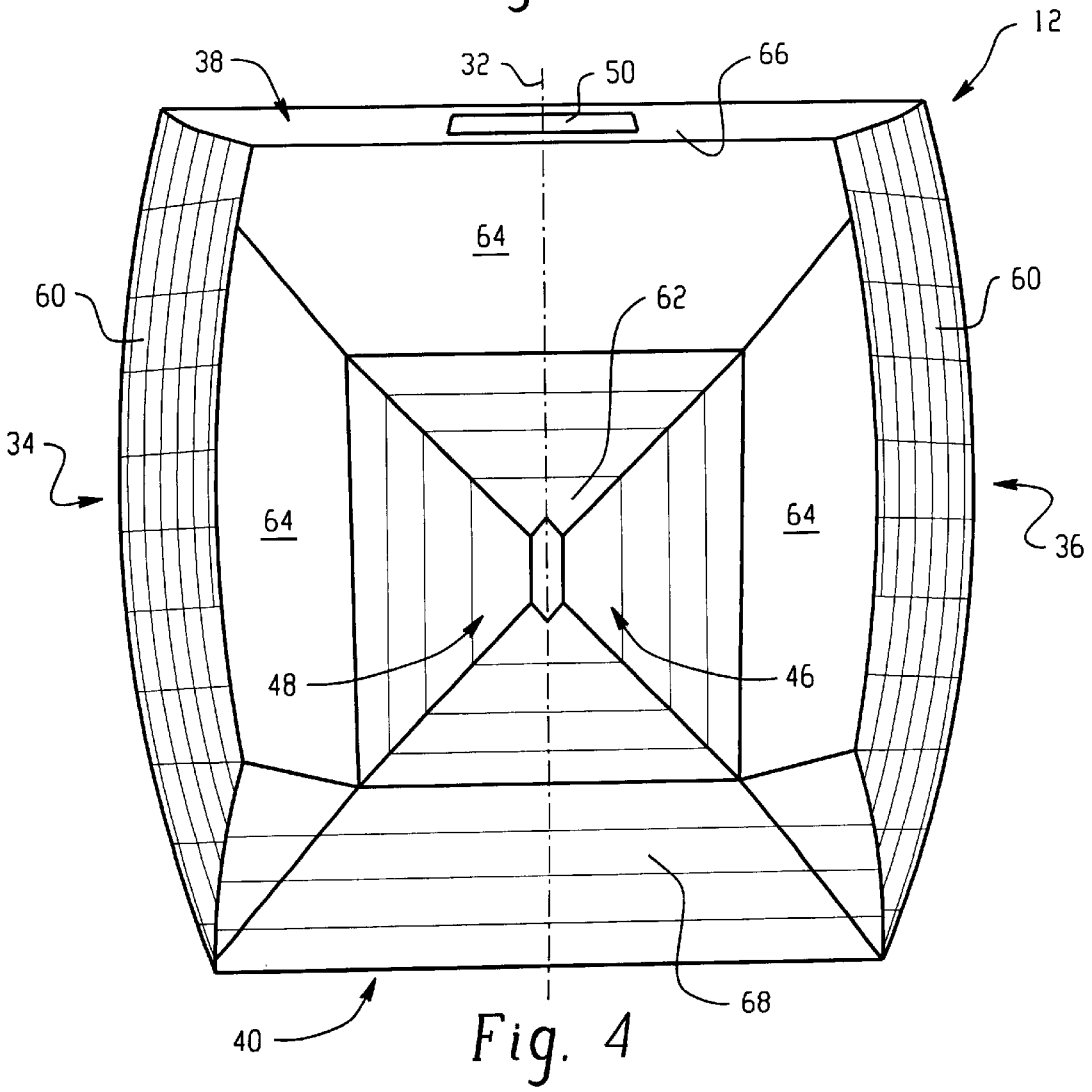
FIG. 4 shows a front view of the reflector of FIG. 2.
Figure 5:
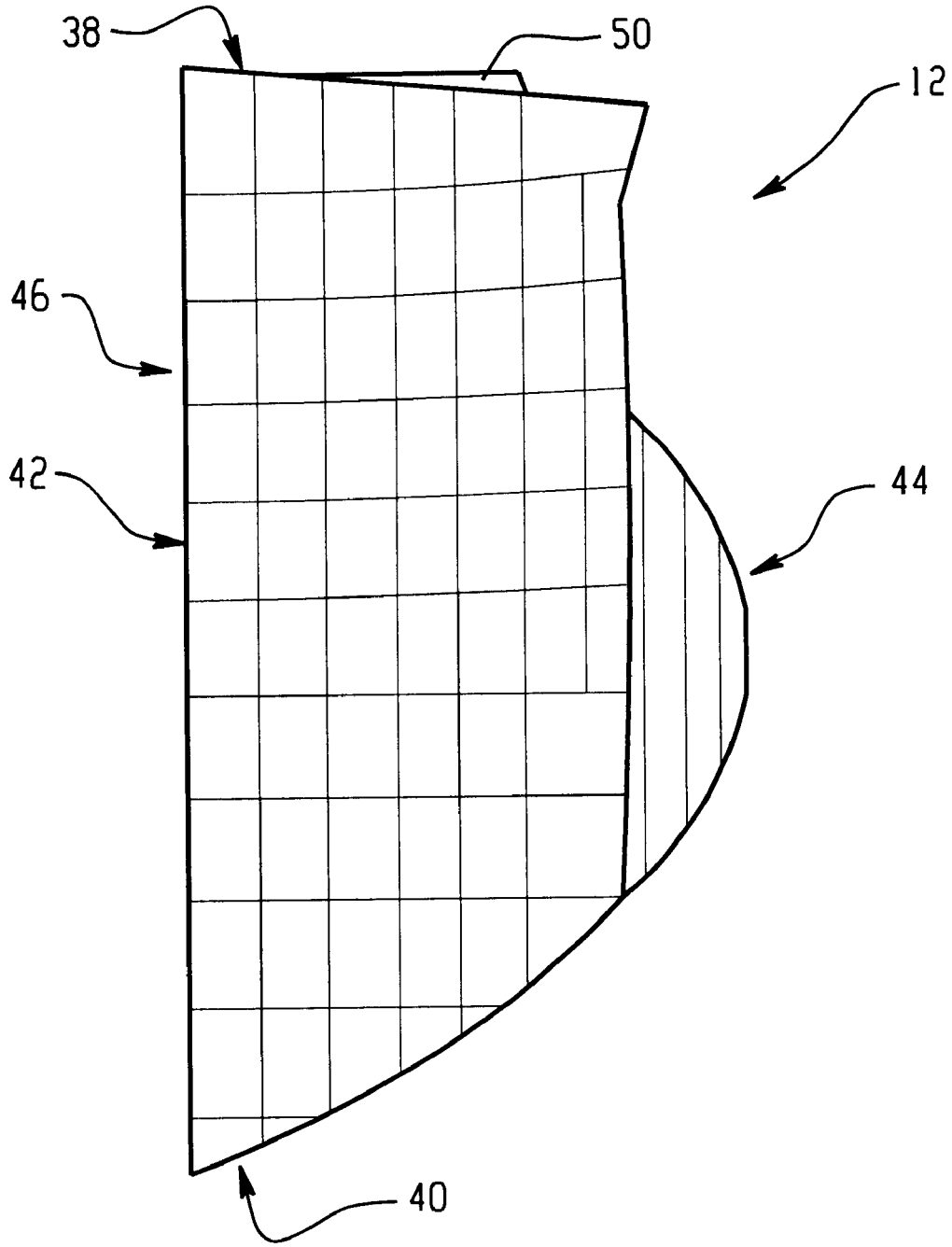
FIG. 5 shows a side view of the reflector of FIG. 2.
Figure 6:
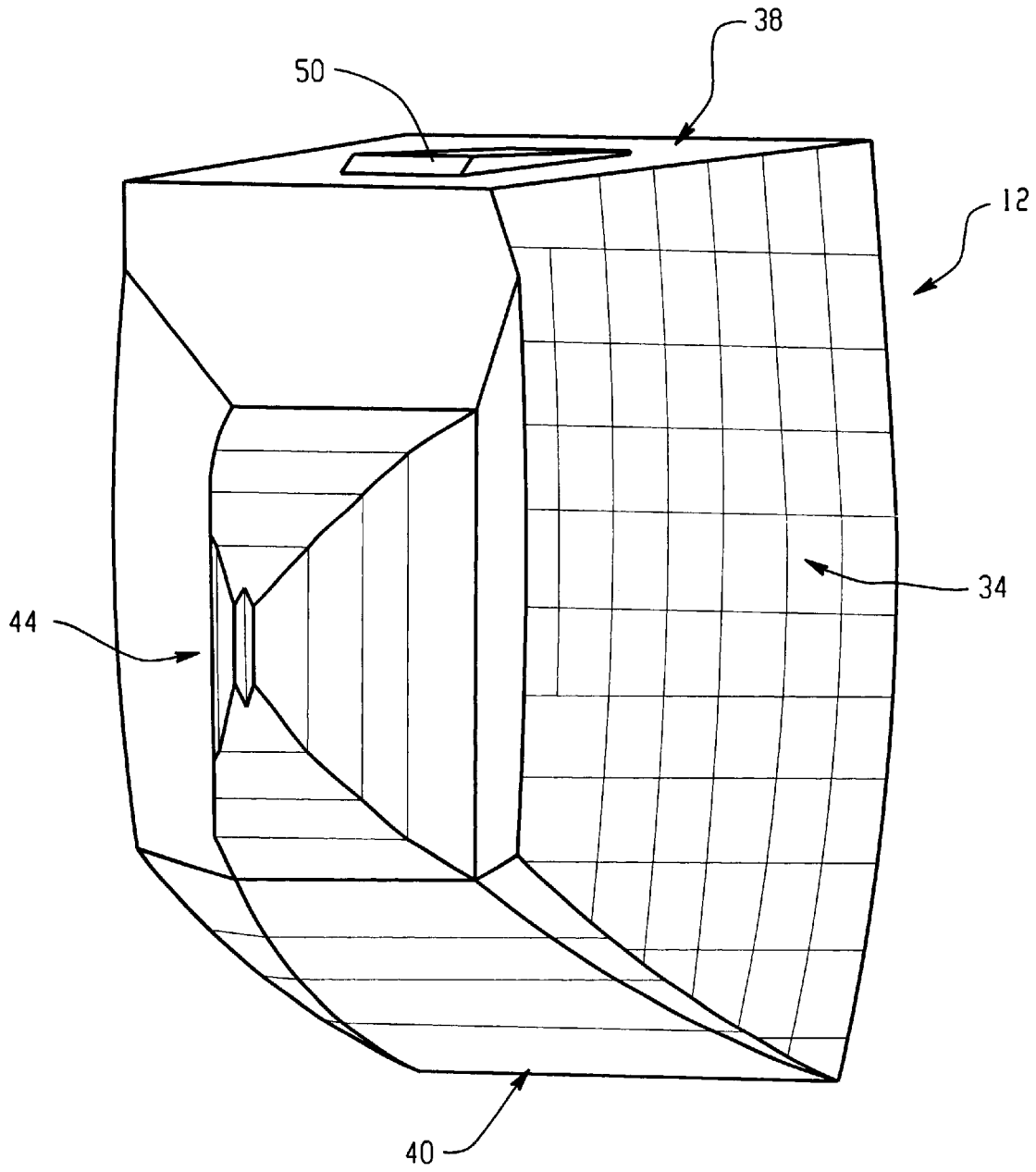
FIG. 6 shows an isometric view offset from the rear of the reflector of FIG. 2.

FIG. 2 through FIG. 6 show an isometric view, a top view, a front view, a side view, and a rearward isometric view, respectively, of the exemplary reflector 12 that suitably practices an embodiment of the invention. The reflector 12 is approximately rectangular when viewed from the front (FIG. 4), and is bilaterally symmetric about a symmetry plane 32 which defines a left side 34 and a right side 36, as best seen in FIGS. 3 and 4. The reflector 12 additionally has a top 38 and a bottom 40, as best seen in FIGS. 3, 4, and 5, and a forward side 42 and a rearward side 44, as best seen in FIGS. 3 and 5. A forward opening 46 is provided from which lamp light is emitted, and the reflector 12 as a whole defines a lamp space 48.

An associated lamp (not shown), which can be a halogen lamp, an incandescent lamp, a metal halide lamp, or other light emitting element, occupies the lamp space 48, i.e. the lamp is arranged inside the reflector 12. In a preferred embodiment for outdoor lighting applications, a relatively high power lamp, e.g. preferably greater than 200 watts input power although the reflector may also be used with lamps of lower wattage, is arranged in vertical fashion in the lamp. The lamp is preferably of the type having a threaded end fastener, e.g. a "screw-in" bulb, in which the threaded fastener has integral electrical connections so that the bulb can be screwed into a lamp socket (not shown) positioned in a lamp socket port 50 to simultaneously effectuate both physical fastening of the light bulb within the reflector 12 and electrical connection of the light bulb to a power supply (not shown). Although in the reflector embodiment shown in FIGS. 2 through 6 the lamp socket port 50 is arranged on the top 38 of the reflector 12, other locations for the lamp socket port are also contemplated, such as locating it on the bottom 40 of the reflector 12.

With reference back to FIG. 1, the operation of the flood light 10 is as follows. The lamp (not shown) generates light essentially emanating from a spatial point, e.g. a spatial point corresponding to a glowing filament or arc tube location. The light is typically emitted roughly uniformly in all directions, albeit with some directionality typically imposed, for example by shadowing produced by the socket. The reflector 12 reflects the generated light to form an expanding rectangular light beam 24 that impinges on the wall 14 to illuminate the rectangular area 20. The expanding rectangular light beam 24 is characterized by an azimuth angle AA and a lateral divergence angle AL which are determined by the detailed surface curvatures of the reflector 12.

In the embodiment illustrated in FIGS. 2 through 6, the reflector 12 comprises a metal form defining several reflective sub-surfaces. With particular reference to FIGS. 2 and 4, these reflective sub-surfaces include a forward reflector surface 60, a rearward reflector surface 62, three essentially planar reflective connecting regions 64, a top essentially planar reflecting surface 66, and a bottom essentially parabolic reflecting surface 68. The rear reflector 62 is essentially parabolic in shape, and is connected by the three planar reflective connecting regions 64 to the top planar reflecting surface 66 and to the forward parabolic reflector 60. The forward reflector 60 is defined by the symmetric sides 34, 36 of the reflector 12, and is also essentially parabolic in shape. The reflector 12 portions that define the top planar reflecting surface 66 and the bottom parabolic reflecting surface 68 join with those defining the forward and rear reflectors 60, 62 and the planar connecting regions 64 to form a single, continuous, reflective metal sheet that is formed, for example, by a hydroform press. Because the sub-surfaces 60, 62, 64, 66, 68 are formed from a single reflective metal sheet in a single forming step, they advantageously have a single, continuous, undifferentiated surface finish. In contrast, the segmented asymmetric reflectors of the prior art can have different surface finishes for the various reflector segments, and additional optical discontinuities can arise at the interconnection of the reflector segments.

As is known to those skilled in the art, light emanating from a point light source positioned near the focus of a parabolic reflector is typically collimated into a beam with a divergence that is determined by the precise spatial positioning of the point light source relative to the parabolic focus. The diverging, substantially rectangular output light beam 24 of the flood light 10 is generated by a superposition of the following contributions: (1) light approximately collimated by the forward and rear parabolic reflectors 60, 62 which are directed in lateral crossing patterns; (2) light approximately collimated by the bottom parabolic reflector 68 that is directed toward the distal portion 26 of the asymmetrically situated rectangular illumination area 20, i.e. that is directed upward toward the top of the area 20 in the exemplary wall illumination of FIG. 1; (3) minimal light reflected off the three connecting reflective planar regions 64 and directed to the forward parabolic reflectors 46; (4) light reflected off the top planar reflective surface 66 which minimally contributes to the light output by spreading the upwardly directed light; and (5) direct lamp illumination that passes through the forward opening 46, without first impinging upon the reflector 12. The contributions (1), (2), and (4) are partially collimated by the parabolic reflectors, while the contributions (3) and (5) are partially collimated by aperturing of the forward opening 46.

As will be recognized by those skilled in the art, the extent and detailed curvature of the reflective surfaces 60, 62, 64, 66, 68, the relative position of the lamp, and the detailed dimensions of the forward opening 46 can be calculated, e.g. using photometric distribution simulations, to obtain an optimized reflector geometry that produces a substantially rectangular diverging beam 24. In a preferred embodiment, a reflector essentially similar to the reflector 12 was designed around a reduced jacket (ED-28) metal halide lamp of about 200 watts or more, and in one embodiment 400 watts, in an essentially vertical orientation. The forward and rear parabolic reflector portions 60, 62 were designed to give peak luminous intensity at a lateral angle AL (FIG. 1) of between about 50° and 70°, and in one preferred embodiment about 60°. The reflector portions were arranged such that the peak luminous intensity in the plane AL=0° was located at a vertical angle AA of between about 30° and 40°, and in one preferred embodiment about 35°. The asymmetry in luminous intensity distribution improves the uniformity of the illumination, enables the tilt angle AT to be minimized and provides greater amount of light to the surface of interest. The top planar reflective surface 66 was oriented to reflect and spread the upwardly directed light, and the three connecting reflective planar regions 64 were angled in toward the lamp at approximately 15°. With the tilt angle AT set to 35°, it was calculated that this designed reflector would illuminate an essentially rectangular area having a vertical Y dimension of 1.33 MD, and a horizontal X dimension of 4 MD with an intensity maximum-to-minimum uniformity ratio of less than 6-to-1 and an intensity average-to-minimum ratio of less than 3-to-1. The designed reflector was estimated to deliver 24% more illumination to the rectangular area as compared with a similar segmented reflector of the prior art.

In addition to improved performance, the reflector 12 has the advantage of being produced by a simplified manufacturing process. The entire reflector is formed as a single piece using only one hydroform press operation, thus eliminating the post-formation assembly required of prior art segmented asymmetric distribution reflectors. As is known to those of ordinary skill in the art, the hydroform press uses a male punch element machined to match the inside dimensions of the piece to be formed, e.g. in the instant case machined to match the inside dimensions of the reflector 12. An aluminum or other metal blank which is to be worked or formed is loaded into the hydroform press between the punch element and a flexible diaphragm that seals a pressurized forming chamber. A blank-holding ring is typically pressed down to hold the blank in place around its edges. As the press drives the punch element into the blank, the metal wraps around and deforms to match the surface of the punch element. The pressurized forming chamber is pressurized by a fluid such as oil so that the flexible diaphragm presses against the worked metal to provide a spatially uniform counter-force for maintaining the worked metal in contact with the punch element uniformly across the pressed area of the blank. The uniform counter-force provided by the flexible diaphragm ensures a close match between the punch element surface structure and the corresponding formed piece, e.g. the reflector 12, and also reduces formation of structural defects in the formed piece, such as surface abrasions, draw marks, and non-uniformly stressed areas.

After the hydroforming step, the lamp socket port 50 and any mounting brackets are cut out, and the unformed portions of the blank are trimmed off. In some cases, mounting structures can be integrally formed during the hydroforming step, and the lamp socket port 50 can be structurally defined as well during the hydroforming to facilitate its removal.

Figure 7:
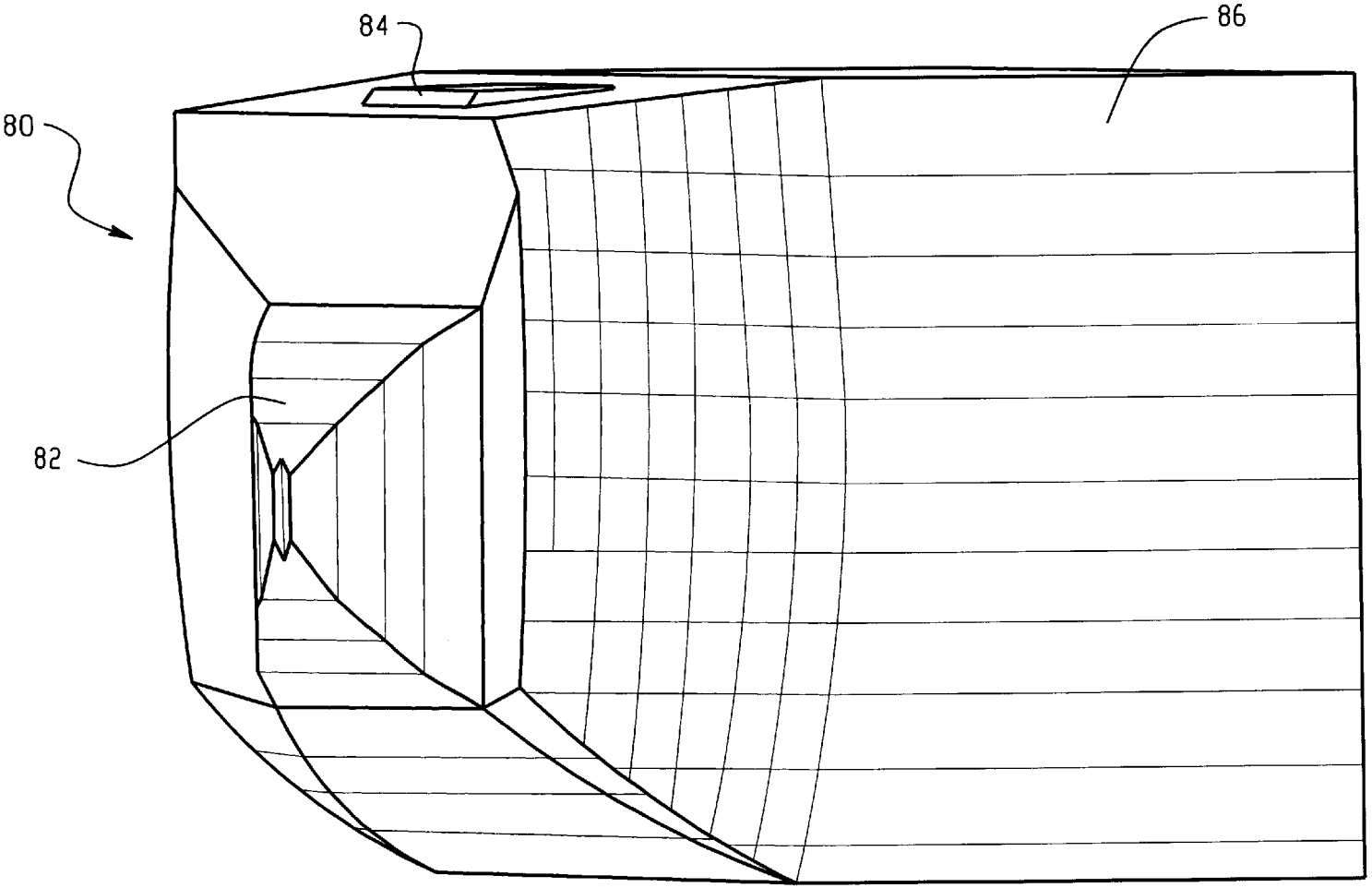
FIG. 7 shows an isometric view of a hydroform punch for use in manufacturing, the reflector of FIG. 2.

With reference to FIG. 7, an exemplary hydroform punch 80 for forming the reflector 12 is shown. The punch 80 includes a surface 82 that has been machined to match the inside dimensions of the reflector 12. The surface 82 also includes a structure 84 corresponding to the lamp socket port 50. The punch 80 further includes a shank 86 for mounting the punch 80 in the hydroform press.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. An asymmetric flood light reflector comprising:

a hydroformed continuous metal form defining a lamp space that is adapted to receive an associated lamp and that has a forward opening for outputting light generated by the associated lamp, the metal form including:

a rear reflector section arranged rearward of the lamp space and adapted to reflect backward-directed lamp illumination forward in a crossing pattern, a forward reflector section disposed forward of the rear reflector section and adapted to reflect lamp illumination forward in a crossing pattern, and a plurality of planar surfaces that connect the forward and rear reflector sections, the hydroformed continuous metal form defining a parabolic bottom section adapted to reflect light through the forward opening and onto a distal portion of the asymmetrically disposed rectangular area, the metal form further adapted to cooperate with the associated lamp to produce a substantially rectangular area of substantially uniform illumination that is asymmetrically disposed relative to the reflector.

2. The asymmetric flood light reflector as set forth in claim 1, wherein the rear reflector section comprises:

a plurality of concave surfaces facing the lamp space.

3. The asymmetric flood light reflector as set forth in claim 1, wherein the forward reflector section comprises:

a plurality of concave surfaces.

4. The asymmetric flood light reflector as set forth in claim 1, wherein the metal form further comprises:

a planar top section adapted to reflect and spread the upwardly directed light.

5. The asymmetric flood light reflector as set forth in claim 1, wherein the metal form further comprises:

an undifferentiated surface finish extending at least over the rear reflector section, the forward reflector section, and the plurality of planar surfaces.

6. A flood light comprising:

a light source; and an asymmetric reflector comprising a single, continuous, reflective metal sheet formed to include bilaterally symmetric sides and a parabolic asymmetric portion, the reflector cooperating with the light source to produce uniform lighting over a rectangular area located asymmetrically relative to the flood light, the plurality of sub-surfaces including, a first plurality of sub-surfaces forming a forward reflector section that reflects light in a crossing pattern, a second plurality of sub-surfaces forming a rear reflector section that reflects light in a crossing pattern, and a third plurality of sub-surfaces comprising planar sub-surfaces connecting the forward and rear reflector sections, said third plurality of sub-surfaces contributing light to the uniform lighting of the rectangular area.

7. The flood light as set forth in claim 6, wherein:

the asymmetric reflector is formed by a hydroform press.

8. The flood light as set forth in claim 6, wherein the reflector includes:

a single, continuous, reflective surface finish covering at least the bilaterally symmetric sides and the parabolic asymmetric portion.

9. The flood light as set forth in claim 6, wherein the light source comprises one of:

a halogen lamp;

an incandescent lamp;

a metal halide lamp; and a high pressure sodium lamp.

10. The flood light as set forth in claim 6, wherein the light source comprises:

a vertically mounted halogen, incandescent, metal halide light, or high pressure sodium bulb having a power input of at least 200 watts, and a threaded fastener with integral electrical connections.

11. The flood light as set forth in claim 6, wherein the bilaterally symmetrical sides include:

symmetrical left and right sides having parabolic sections that effectuate reflection of light in a crossing pattern.

12. A flood light comprising:

a light source; and an asymmetric reflector comprising a single, continuous, reflective metal sheet formed to include a plurality of reflective sub-surfaces including a bottom having a parabolic sub-surface that reflects light at an upward angle with a peak luminous intensity at between 30° and 40°, the reflector cooperating with the light source to produce uniform lighting over a rectangular area located asymmetrically relative to the flood light.

13. The flood light as set forth in claim 12, wherein:

the asymmetric reflector is formed by a hydroform press.

14. The flood light as set forth in claim 12, wherein the plurality of reflective sub-surfaces include:

a single, continuous, reflective surface finish covering the plurality of reflective sub-surfaces.

15. A flood light comprising:

a light source; and an asymmetric reflector comprising a single, continuous, reflective metal sheet formed to include a plurality of reflective sub-surfaces including symmetrical left and right sides having parabolic sub-surfaces effectuating reflection of light in a crossing pattern having a peak luminous intensity at between 50° and 70° laterally, the reflector cooperating with the light source to produce uniform lighting over a rectangular area located asymmetrically relative to the flood light.

16. The flood light as set forth in claim 15, wherein:

the asymmetric reflector is formed by a hydroform press.

17. The flood light as set forth in claim 15, wherein the plurality of reflective sub-surfaces include:

a single, continuous, reflective surface finish covering the plurality of reflective sub-surfaces.

18. A method far flood lighting an asymmetrically disposed rectangular area in a substantially uniform manner, the method comprising:

defining a lamp space, by a hydroformed continuous metal form, that is adapted to receive an associated lamp;

outputting light generated by the associated lamp from a forward opening of the lamp space wherein the outputting step includes, reflecting backward-directed lamp illumination forward in a crossing pattern by use of a rear reflector section arranged rearward of the lamp space, reflecting lamp illumination forward in a crossing pattern by use of a forward reflector section disposed forward of the rear reflector section, connecting the forward and rear reflector sections by a plurality of planar surfaces, reflecting light through the forward opening and onto a distal portion of the asymmetrically disposed rectangular area, by a parabolic bottom section, wherein the metal form is thereby adapted to cooperate with the associated lamp to produce the substantially rectangular area of substantially uniform illumination that is asymmetrically disposed relative to the reflector.

19. The method as set forth in claim 18, further comprising:

prior to the reflecting, hydroforming the single metal sheet into the pre-selected deformation shape.

20. An apparatus for manufacturing an asymmetric flood light reflector, the apparatus comprising:

a punch element adapted for use with a hydroform press, the punch element conforming with the inner surface of an asymmetric flood light reflector, the punch element having a bilaterally symmetric shape including:

bilaterally symmetric sides that conform to bilaterally symmetric sides of the asymmetric flood light reflector, a first asymmetric portion conforming to a parabolic asymmetric portion of the asymmetric flood light reflector, and a second asymmetric portion conforming to a planar portion of the asymmetric flood lighting reflector.

21. The apparatus as set forth in claim 20, further comprising:

a hydroform press that operatively receives the punch element.

* * * * *